US009162283B1

(12) United States Patent
Kado et al.

(10) Patent No.: US 9,162,283 B1
(45) Date of Patent: Oct. 20, 2015

(54) TILTING GRAVITY CASTING APPARATUS AND TILTING GRAVITY CASTING METHOD

(71) Applicant: RYOBI LTD., Fuchu (JP)

(72) Inventors: Yousuke Kado, Fuchu (JP); Hitoshi Ishida, Fuchu (JP); Mitsumasa Sato, Fuchu (JP)

(73) Assignee: RYOBI LTD., Fuchu-shi (JP)

( * ) Notice: Subject to any disclaimer, the term of this patent is extended or adjusted under 35 U.S.C. 154(b) by 20 days.

(21) Appl. No.: 14/251,064

(22) Filed: Apr. 11, 2014

(51) Int. Cl.

| | |
|---|---|
| ***B22D 23/00*** | (2006.01) |
| ***B22D 37/00*** | (2006.01) |
| ***B22C 9/00*** | (2006.01) |
| ***B22D 46/00*** | (2006.01) |
| ***B22D 41/04*** | (2006.01) |

(52) U.S. Cl.
CPC . *B22D 37/00* (2013.01); *B22C 9/00* (2013.01); *B22D 23/006* (2013.01); *B22D 41/04* (2013.01); *B22D 46/00* (2013.01)

(58) Field of Classification Search
CPC ..... B22D 23/006; B22D 2/003
USPC ..... 164/136, 335, 336
See application file for complete search history.

(56) References Cited

U.S. PATENT DOCUMENTS

| | | | | |
|---|---|---|---|---|
| 6,125,918 | A * | 10/2000 | Berge | 164/457 |
| 8,387,678 | B1 * | 3/2013 | Park et al. | 164/133 |
| 2009/0229782 | A1 * | 9/2009 | Takada | 164/336 |

FOREIGN PATENT DOCUMENTS

| | | | |
|---|---|---|---|
| JP | 9253828 | A | 9/1997 |
| JP | 2012196698 | A | 10/2012 |
| JP | 2013056347 | A | 3/2013 |
| JP | 2013193100 | A * | 9/2013 |

* cited by examiner

*Primary Examiner* — Kevin E Yoon
(74) *Attorney, Agent, or Firm* — The Webb Law Firm

(57) ABSTRACT

In a tilting gravity casting apparatus, a die includes a ladle that stores a molten metal and the molten metal is poured through a runner into a cavity of the die when the die is tilted. The apparatus includes a block member for blocking the runner, a pressing pin for pressing the molten metal in the cavity, a controller that controls operation of driving the block member and the pressing pin, and a first molten metal sensing sensor disposed in the runner. The controller is configured to start driving the block member and the pressing pin based on a detection signal outputted from the first molten metal sensing sensor.

8 Claims, 6 Drawing Sheets

TILTING GRAVITY CASTING APPARATUS AND TILTING GRAVITY CASTING METHOD

BACKGROUND OF THE INVENTION

1. Field of the Invention

The present invention relates to a tilting gravity casting apparatus and a tilting gravity casting method using the apparatus.

2. Background Art

A tilting gravity casting apparatus in which a die includes a molten metal basin (ladle) that stores a molten metal and the molten metal is poured into a cavity in the die through a runner when the die is tilted is well known as described, for example, in Patent Literature 1 mentioned below.

Such a tilting gravity casting apparatus of related art has the following problems when producing a cast product having a complicated shape, such as a knuckle for an automobile, which is a part that connects a bearing supporting a wheel to a suspension: The cavity in the die cannot be filled with molten metal all the way down to the end of the cavity; and a cast product cannot be sufficiently free of shrinkage cavities and other casting defects.

PRIOR ART LITERATURE

Patent Literature

Patent Literature 1: Japanese Patent Application Laid-Open No. 9-253828

The present invention therefore has been made in view of the problems with related art described above. An object of the present invention is to provide a tilting gravity casting apparatus and a tilting gravity casting method using the apparatus that are excellent in filling a die cavity with a molten metal and are capable of forming a cast product sufficiently free of casting defects, and another object of the present invention is to provide.

SUMMARY OF THE INVENTION

The present invention has been made to achieve the object described above. A tilting gravity casting apparatus according to the present invention is a tilting gravity casting apparatus 1 in which a die 2 includes a ladle 7, which stores a molten metal M, and the molten metal M is poured through a runner 5 into a cavity 6 of the die 2 when the die 2 is tilted, the apparatus including a block member 18 for blocking the runner 5, a pressing pin 23 for pressing the molten metal M in the cavity 6, a controller that controls operation of driving the block member 18 and the pressing pin 23, and a first molten metal sensing sensor 24 disposed in the runner 5, and the controller starts driving the block member 18 and the pressing pin 23 based on a detection signal outputted from the first molten metal sensing sensor 24.

It is preferable in the tilting gravity casting apparatus that the die 2 have an upper die 4 and a lower die 3, that the runner 5 have a molten metal storage 5C recessed in the upper die 4, and that the first molten metal sensing sensor 24 be disposed above the molten metal storage 5C.

It is further preferable in the tilting gravity casting apparatus that a second molten metal sensing sensor 26 be disposed in the vicinity of an inlet 5A of the runner 5, and that the controller measure the time elapsed from the time when a detection signal outputted from the second molten metal sensing sensor 26 is transmitted to the controller to the time when the detection signal outputted from the first molten metal sensing sensor 24 is transmitted to the controller.

A tilting gravity casting method according to the present invention includes performing casting by using the tilting gravity casting apparatus 1.

According to the tilting gravity casting apparatus and the tilting gravity casting method of the present invention, the cavity of the die can be filled with the molten metal all the way down to the end of the cavity, and a cast product can be sufficiently free of casting defects.

DETAILED DESCRIPTION OF THE PREFERRED EMBODIMENT

Figure 1:
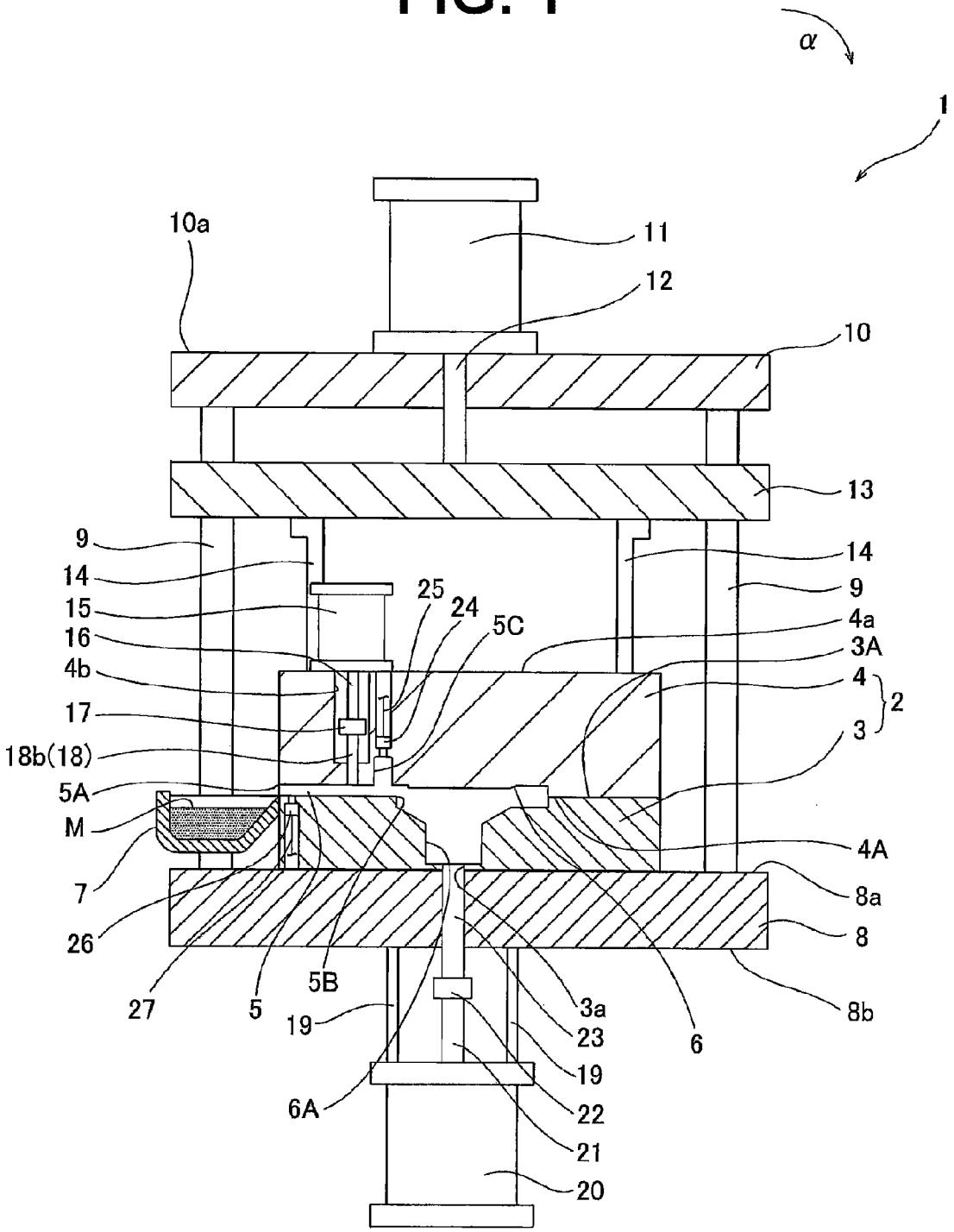
FIG. 1 is a cross-sectional view of a tilting gravity casting apparatus according to an embodiment of the invention.

A tilting gravity casting apparatus according to an embodiment of the present invention will be described with reference to the drawings. A tilting gravity casting apparatus 1 includes a die 2 formed of a lower fixed die 3 and an upper movable die 4, and the fixed die 3 and the movable die 4 define a runner 5 and a cavity 6, as shown in FIG. 1. In the present embodiment, a groove formed in a movable die partition surface 4A and a fixed die partition surface 3A define the runner 5. A ladle 7 is fixed to the fixed die 3 and stores a molten metal M, such as an aluminum alloy.

The fixed die 3 is fixed to an upper surface 8*a* of a base 8. The lower end of each guide shaft 9 is fixed to the base 8, and the upper end of each of the guide shafts 9 is fixed to a top plate 10. A hydraulic cylinder 11 is fixed to an upper surface 10*a* of the top plate 10, and the leading end of a cylinder rod 12, which passes through the top plate 10, is connected to a movable plate 13, which is disposed below the top plate 10. When the hydraulic cylinder 11 is driven, the movable plate 13 is guided along the guide shafts 9 and movable between the base 8 and the top plate 10 upward and downward in FIG. 1. Connection members 14 are provided below the movable plate 13 and connect the movable plate 13 to the movable die 4. The movable die 4 is therefore movable along with the movable plate 13 between the base 8 and the top plate 10 upward and downward in FIG. 1.

The tilting gravity casting apparatus 1 includes a tilting mechanism (not shown). The tilting mechanism has a well-known configuration. The tilting mechanism includes a tilting shaft provided in the base 8 and extending in the direction perpendicular to the plane of view of FIG. 1, a support arm (not shown) that supports the tilting shaft, and a tilting motion drive device attached to the support arm. The tilting motion drive device is controlled by a controller that will be described later and is capable of tilting the base 8 and the die 2 by about 90 degrees at a predetermined speed from the horizontal state shown in FIG. 1 in the direction indicated by the arrow a.

Figure 2:
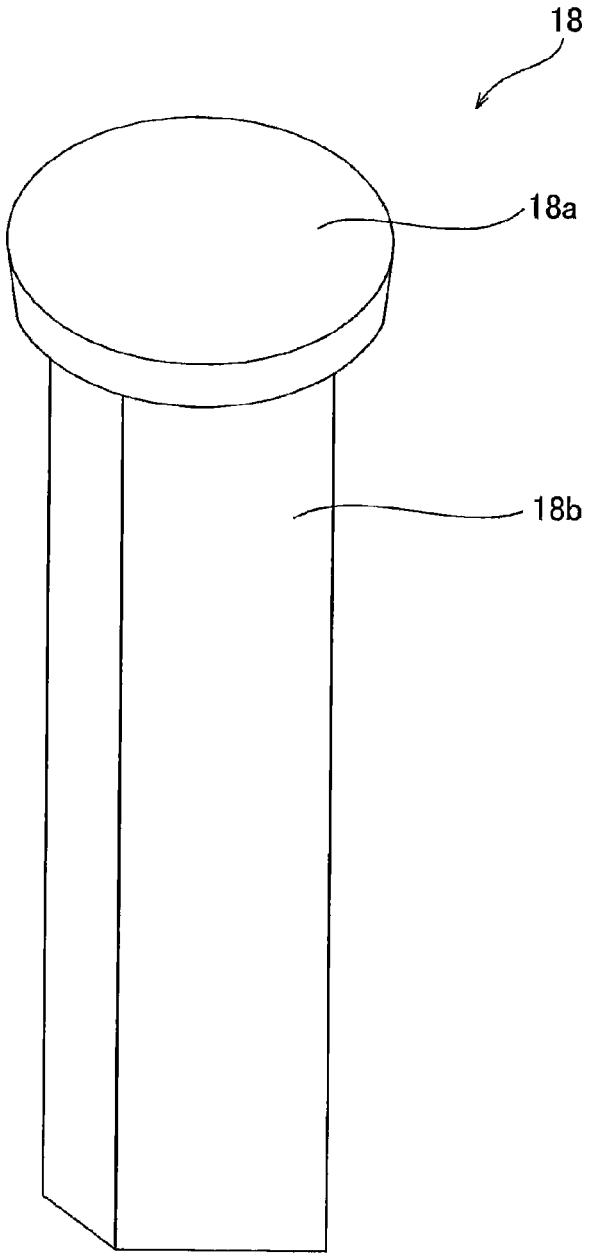
FIG. 2 is a perspective view of a block member.

A hydraulic cylinder 15, which serves as a block member drive device, is fixed to an upper surface 4*a* of the movable die 4. A cylinder rod 16 of the hydraulic cylinder 15 is connected to a block member 18 via a coupling 17 in a hole 4*b* formed in the movable die 4. The block member 18 has a circular-column-shaped head 18*a*, which is accommodated in the coupling 17, and a square-column-shaped shaft 18*b*, as shown in FIG. 2. The block member 18 is disposed in a position slightly shifted from the center between an inlet 5A and an outlet 5B of the runner 5 toward the outlet 5B. When the controller that will be described later drives the hydraulic cylinder 15, the leading end surface of the shaft 18*b* enters and blocks the runner 5.

A hydraulic cylinder 20, which serves as a pressing pin drive device, is fixed to a lower surface 8*b* of the base 8 via support rods 19. A cylinder rod 21 of the hydraulic cylinder 20 is connected to a pressing pin 23 via a coupling 22. The pressing pin 23 passes through the base 8 and is disposed in a hole 3*a* formed in the fixed die 3. When the controller that will be described later drives the hydraulic cylinder 20, the leading end of the pressing pin 23 enters the cavity 6, which will be described later, and the pressing pin 23 presses the molten metal M in the cavity 6.

An extruding pin (not shown) is provided in the die 2. After the movable die 4 is parted from the fixed die 3, the extruding pin can extrude the molten metal M having solidified in the runner 5 and the cavity 6 out of the die 2. Further, an air gap around the extruding pin forms a gas discharge path (not shown) that passes through the die 2, and a degassing device (not shown) is connected to the gas discharge path. The degassing device can suck and discharge gases in the cavity 6 in a die tilt step that will be described later and can supply the gas discharge path with air in a parting agent application step that will be described later.

The runner 5, through which the molten metal M moves, has a substantially rectangular cross-sectional shape when taken along the direction perpendicular to the plane of view of FIG. 1, and is defined by: a lateral-U-shaped groove formed in the movable the partition surface 4A; and the fixed die partition surface 3A, in such a way that the runner 5 extends rightward and leftward in FIG. 1. The runner 5 has a molten metal storage 5C in the vicinity of the outlet 5B. The molten metal storage 5C is a hole further recessed upward in FIG. 1 from the bottom surface of the lateral-U-shaped groove formed in the movable die partition surface 4A, which defines the runner 5, and a first molten metal sensing sensor 24 is disposed above the hole. Specifically, the first molten metal sensing sensor 24 is so disposed in the movable die 4 that the sensor 24 is exposed through the bottom of the hole. The first molten metal sensing sensor 24 is an electrical detection sensor having a well-known configuration and outputs a detection signal when the molten metal M which flowed into the molten metal storage 5C and rose to the bottom of the hole, has come into contact with the first molten metal sensing sensor 24. The detection signal is transmitted to the controller that will be described later via a wiring line 25.

A second molten metal sensing sensor 26 is disposed in the vicinity of the inlet 5A of the runner 5. Specifically, the second molten metal sensing sensor 26 is so disposed in the fixed die 3 that the sensor 26 is exposed through a fixed die partition surface 3A, which defines the runner 5. The second molten metal sensing sensor 26 is an electrical detection sensor having a well-known configuration and outputs a detection signal when the molten metal M which flowed through the inlet 5A of the runner 5 has come into contact with the second molten metal sensing sensor 26. The detection signal is transmitted to the controller that will be described later via a wiring line 27.

The tilting gravity casting apparatus 1 includes the controller (not shown) that controls the tilting motion drive device, the block member drive device, the pressing pin drive device, and other drive devices. The controller emits a signal that starts driving the hydraulic cylinder 15 at the same time as the detection signal outputted from the first molten metal sensing sensor 24 is transmitted to the controller, so as to start blocking the runner 5 by driving the block member 18. The controller further emits a signal that starts driving the hydraulic cylinder 20 at predetermined timing after the controller emits the signal that starts driving the hydraulic cylinder 15, so as to start pressing the molten metal M in the cavity 6 by driving the pressing pin 23.

The controller further measures the time elapsed from the time when the detection signal outputted from the second molten metal sensing sensor 26 is transmitted to the controller to the time when the detection signal outputted from the first molten metal sensing sensor 24 is transmitted to the controller. When the measured time is shorter than a predetermined value, the controller does not emit the signals that start driving the hydraulic cylinders 15 and 20 but notifies an operator of failure in filling the cavity with the molten metal or any other type of abnormality in the form of a buzzer or any other notification device.

A description will next be made of a tilting gravity casting method using the tilting gravity casting apparatus 1. In the tilting gravity casting method, a molten metal preparation step of storing the molten metal M in the ladle 7 is first carried out to achieve the state shown in FIG. 1.

A the tilt step is then initiated, in which the die 2 is tilted from the state shown in FIG. 1 by about 90° in the direction indicated by the arrow a so that the molten metal M in the ladle 7 is poured through the runner 5 into the cavity 6. The die 2 is tilted by the tilting mechanism (not shown) at a predetermined speed. With the die 2 being tilted in the die tilt step, the molten metal M in the ladle 7 is poured through the runner 5 into the cavity 6. Specifically, when the molten metal M flows into the inlet 5A of the runner 5 and comes into contact with the second molten metal sensing sensor 26, the second molten metal sensing sensor 26 emits the detection signal, which is transmitted to the controller via the wiring line 26.

Figure 3:
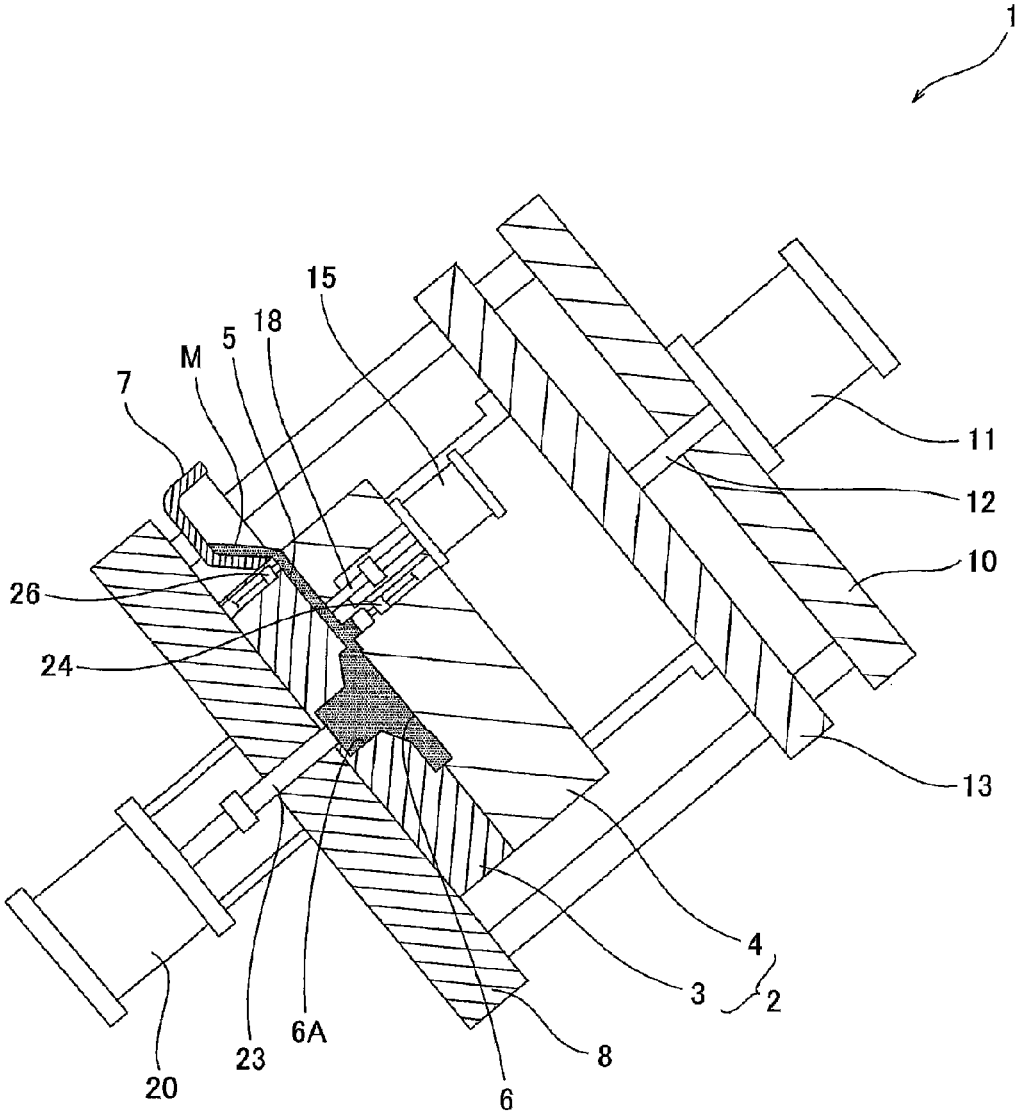
FIG. 3 is a view describing a state in which a die is tilted by 45° in a the tilt step.
Figure 4:
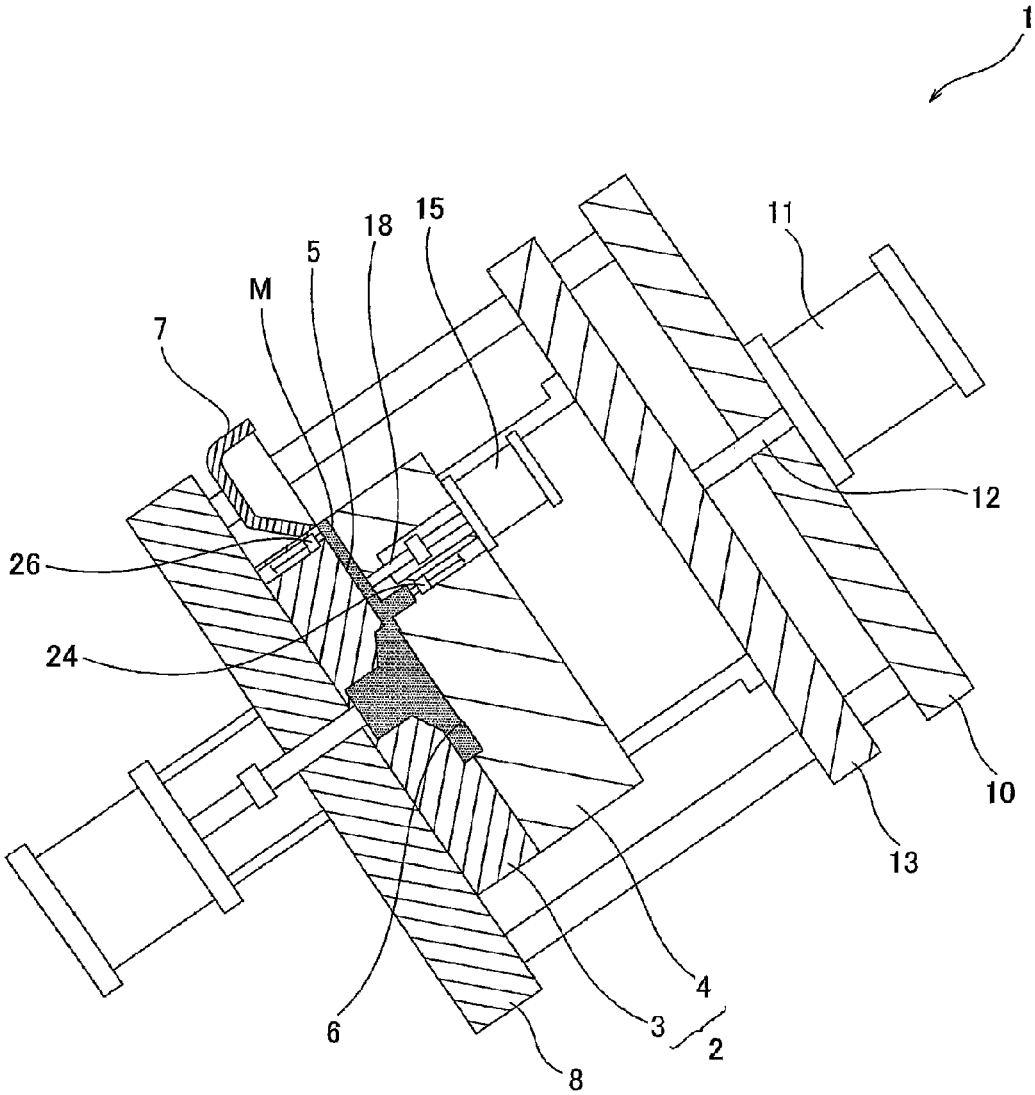
FIG. 4 is a view describing a state in which a molten metal storage in a runner is filled with molten metal.

When the die 2 is tilted by about 45° and the cavity 6 is substantially filled with the molten metal M, the molten metal M rises through the molten metal storage 5C, which is located in the vicinity of the outlet of the runner 5, as shown in FIG. 3. When the molten metal storage 5C is filled with the molten metal M and the molten metal M comes into contact with the first molten metal sensing sensor 24 as shown in FIG. 4, the first molten metal sensing sensor 24 outputs the detection signal. When the detection signal is transmitted to the controller via the wiring line 25, the controller emits a signal that starts driving the hydraulic cylinder 15 to initiate a runner block step of blocking the runner 5 by causing the leading end surface of the block member 18 to abut (or approach) the fixed die partition surface 3A.

Figure 5:
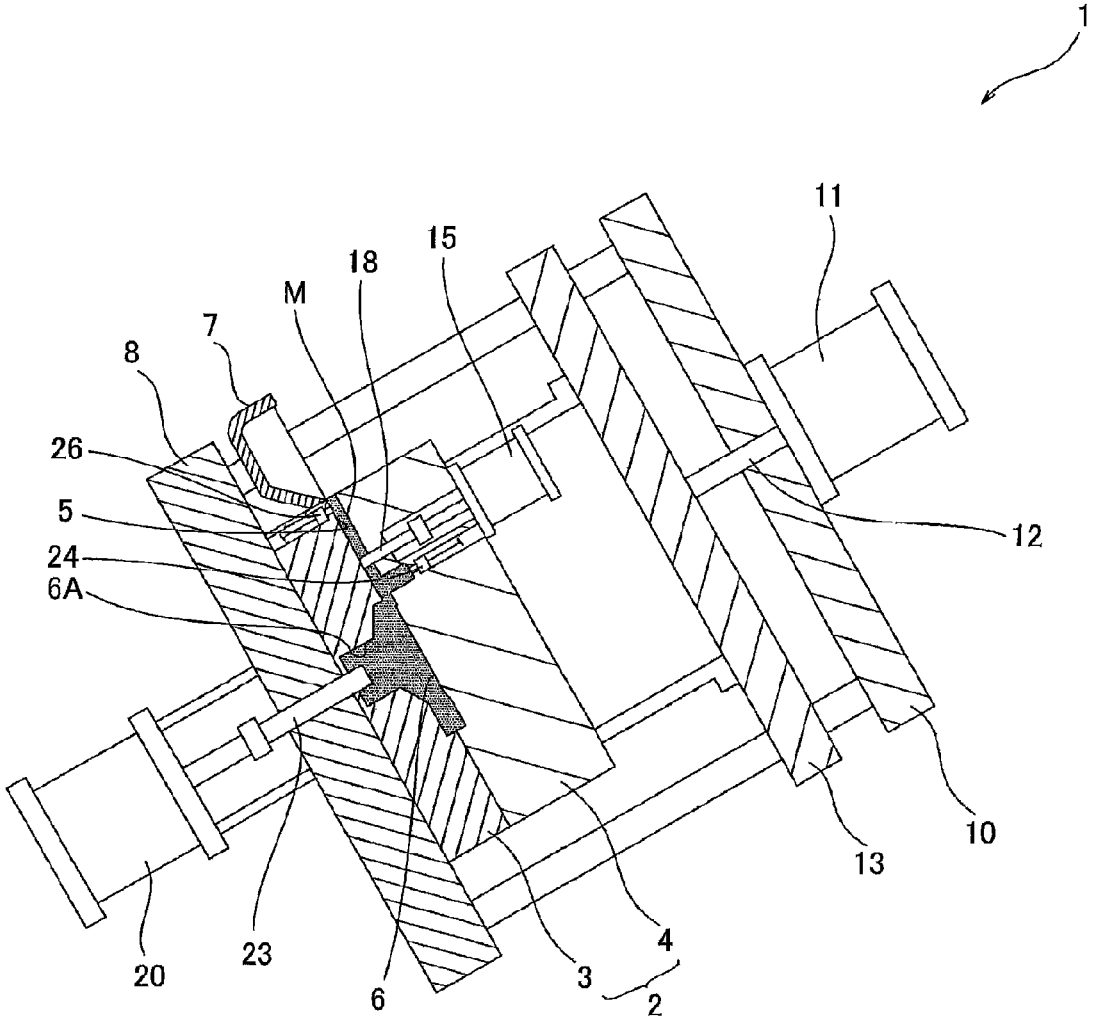
FIG. 5 is a view describing a state in which a pressing pin presses the molten metal after the runner is blocked with a block member.

After the block member 18 blocks the runner 5 in the runner block step, the controller emits a signal that drives the hydraulic cylinder 20 to initiate a press step of causing the pressing pin 23 to enter the cavity 6 (see FIG. 5). At an appropriate timing after the cavity 6 is filled with the molten metal M and the runner 5 is blocked, the press step is initiated to cause the pressing pin 23 to press the molten metal M in the cavity 6. The press step allows a surface layer in, for example, the end of the cavity 6 that tends to separate from the die 2 due to solidification shrinkage to be pressed against the die 2. Further, the molten metal M corresponding to the loss due to the solidification shrinkage can be forced inside by pressure in the press step, whereby a cast product C (see FIG. 6) can be sufficiently free of shrinkage cavities and other casting defects.

The controller measures the time elapsed from the time when the detection signal outputted from the second molten metal sensing sensor 26 is transmitted to the controller to the time when the detection signal outputted from the first molten metal sensing sensor 24 is transmitted to the controller. When the measured time is shorter than a predetermined value, the controller does not initiate the runner block step or the press step but notifies the operator of failure in filling the cavity with the molten metal or any other type of abnormality in the form of a buzzer or any other notification device.

Figure 6:
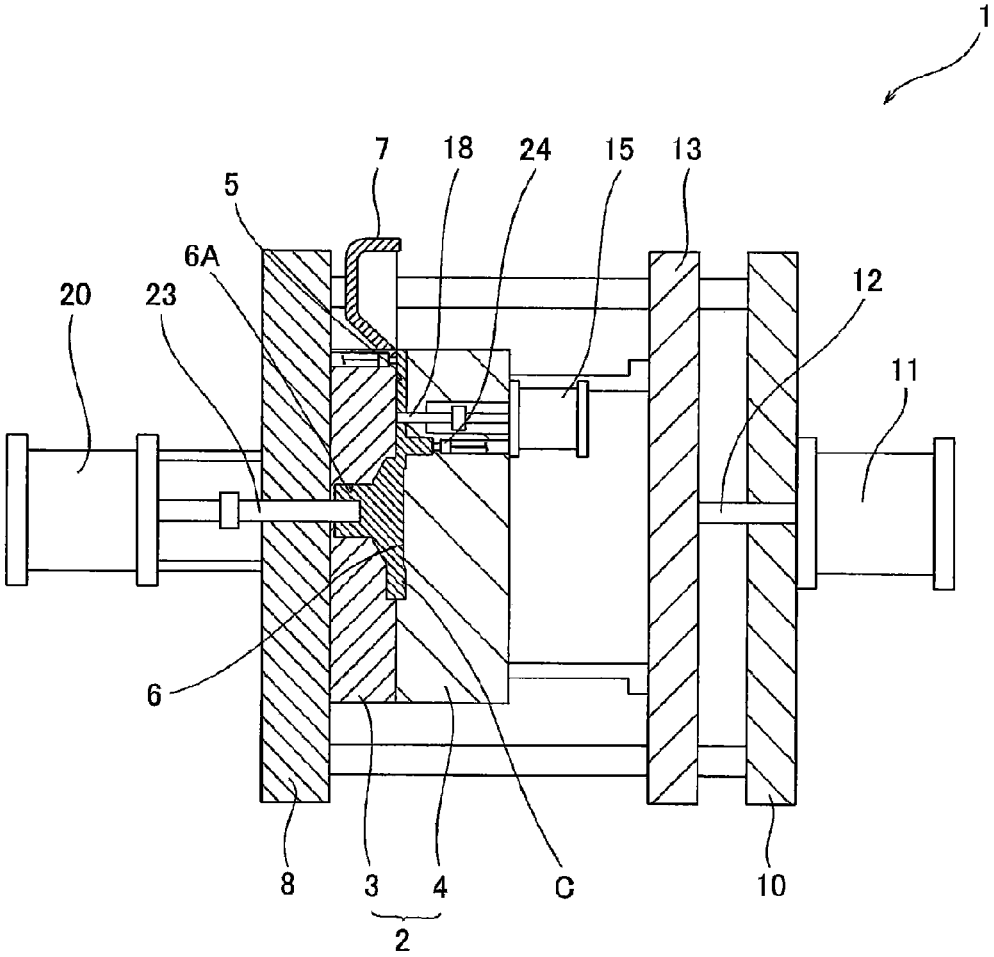
FIG. 6 is a view describing a state in which the die tilt step is completed.

The tilting operation continues after the press step is completed but is terminated when the state shown in FIG. 6, which is the state after the state shown in FIG. 1 is tilted by about 90°, is achieved, and the die tilt step is completed.

When a the cooling device (not shown) causes the molten metal in the cavity 6 to solidify, the hydraulic cylinder 20 is driven to retract the pressing pin 23 leftward in FIG. 6, and then a the open step is carried out. In the die open step, the hydraulic cylinder 11 is driven to move the movable plate 13 along with the movable die 4 rightward in FIG. 6 so that the movable die 4 is parted from the fixed die 3. The following steps are then sequentially carried out: a cast product removal step of removing the cast product from the die 2 by using the extruding pin (not shown) provided in the die 2; a parting agent application step of applying a parting agent onto the runner 5 and the cavity 6; and a die clamping step of driving the hydraulic cylinder 11 to move the movable plate 13 along with the movable die 4 leftward in FIG. 6 so that the movable die 4 abuts the fixed die 3. Finally, the tilt mechanism is used to restore the state of the die 2 shown in FIG. 1. The tilting gravity casting method has been described above.

According to the tilting gravity casting apparatus 1 and the tilting gravity casting method of the present embodiment, the detection signal outputted from the first molten metal sensing sensor 24 disposed in the runner 5 allows the controller to recognize the time when the cavity 6 is filled with the molten metal M, and the controller initiates the runner block step using the block member 18 and the press step using the pressing pin 23 based on the detection signal, whereby the runner block step and the press step can be carried out at an appropriate timing. Therefore, the cavity 6 of the die 2 can be filled with the molten metal M all the way down to the end of the cavity 6, and the cast product C can be sufficiently free of casting defects.

Further, since the controller measures the time elapsed from the time when the detection signal outputted from the second molten metal sensing sensor 26 is transmitted to the controller to the time when the detection signal outputted from the first molten metal sensing sensor 24 is transmitted to the controller, failure in filling the cavity with the molten metal or any other type of abnormality can be detected and the speed at which the tilt motion drive device performs the tilting operation can be changed based on the measured time.

The tilting gravity casting apparatus and the tilting gravity casting method according to the present invention are not limited to those described in the above embodiment, and a variety of changes and modifications can be made thereto to the extent that they fall within the scope of the claims. For example, in the embodiment described above, the pressing pin 23 is disposed on the side where the fixed die 3 is present, but the pressing pin 23 may instead be disposed on the side where the movable die 4 is present.

Further, in the embodiment described above, the press step is completed before the die tilt step is completed, but the initiated press step may be allowed to continue after the die tilt step is completed.

Further, in the embodiment described above, the press step is completed before the die tilt step is completed, but after the die tilt step is completed, the locked pressing pin may be unlocked and the press step may be resumed.

DESCRIPTION OF THE REFERENCE NUMBERS

1 Tilting gravity casting apparatus
2 Die
3 Fixed die
3A Fixed die partition surface
4 Movable die
4A Movable die partition surface
4*a* Upper surface
5 Pouring gate
5A Inlet
5B Outlet
5C Molten metal storage
6 Cavity
7 Ladle
8 Base
8*a* Upper surface
8*b* Lower surface
9 Guide shaft
10 Top plate
10*a* Upper surface
11 Hydraulic cylinder
12 Cylinder rod
13 Movable plate
14 Connection shaft
15 Hydraulic cylinder
16 Cylinder rod
17 Coupling
18 Block member
18*a* Head
18*b* Shaft
19 Support rod
20 Hydraulic cylinder
21 Cylinder rod
22 Coupling
23 Pressing pin
24 First molten metal sensing sensor
25 Wiring line
26 Second molten metal sensing sensor
27 Wiring line
M Molten metal
C Cast product

What is claimed is:

1. A tilting gravity casting apparatus in which a die includes a ladle that stores a molten metal and the molten metal is poured through a runner into a cavity of the die when the die is tilted, the apparatus comprising:

a block member for blocking the runner;

a pressing pin for pressing the molten metal in the cavity;

a controller that controls operation of driving the block member and the pressing pin; and a first molten metal sensing sensor disposed in the runner, wherein the controller starts driving the block member and the pressing pin based on a detection signal outputted from the first molten metal sensing sensor.

2. The tilting gravity casting apparatus according to claim 1, wherein the die has an upper die and a lower die, the runner has a molten metal storage recessed in the upper die, and the first molten metal sensing sensor is disposed above the molten metal storage.

3. The tilting gravity casting apparatus according to claim 2, wherein a second molten metal sensing sensor is disposed in the vicinity of an inlet of the runner, and the controller measures the time elapsed from the time when a detection signal outputted from the second molten metal sensing sensor is transmitted to the controller to the time when the detection signal outputted from the first molten metal sensing sensor is transmitted to the controller.

4. The tilting gravity casting apparatus according to claim 1, wherein a second molten metal sensing sensor is disposed in the vicinity of an inlet of the runner, and the controller measures the time elapsed from the time when a detection signal outputted from the second molten metal sensing sensor is transmitted to the controller to the time when the detection signal outputted from the first molten metal sensing sensor is transmitted to the controller.

5. A tilting gravity casting method comprising performing casting by using the tilting gravity casting apparatus according to claim 1.

6. A tilting gravity casting method comprising performing casting by using the tilting gravity casting apparatus according to claim 2.

7. A tilting gravity casting method comprising performing casting by using the tilting gravity casting apparatus according to claim 3.

8. A tilting gravity casting method comprising performing casting by using the tilting gravity casting apparatus according to claim 4.

* * * * *